US007561110B2

(12) United States Patent
Chen

(10) Patent No.: US 7,561,110 B2
(45) Date of Patent: Jul. 14, 2009

(54) PRINTED ANTENNA AND A WIRELESS NETWORK DEVICE HAVING THE ANTENNA

(75) Inventor: Yu Ren Chen, Luodong Township, Yilan County (TW)

(73) Assignee: Cameo Communications Inc., Taipei County (TW)

( * ) Notice: Subject to any disclaimer, the term of this patent is extended or adjusted under 35 U.S.C. 154(b) by 360 days.

(21) Appl. No.: 11/415,248

(22) Filed: May 2, 2006

(65) Prior Publication Data

US 2007/0164920 A1 Jul. 19, 2007

(30) Foreign Application Priority Data

Jan. 13, 2006 (TW) ..... 95200898 U

(51) Int. Cl.
*H01Q 1/24* (2006.01)

(52) U.S. Cl. ..... 343/702

(58) Field of Classification Search ..... 343/702, 343/795, 700 MS
See application file for complete search history.

(56) References Cited

U.S. PATENT DOCUMENTS 5,949,376 A * 9/1999 McDonald et al. .... 343/700 MS
6,882,338 B2 * 4/2005 Flowers ..... 345/174
2004/0036654 A1 * 2/2004 Hsieh ..... 343/702
2005/0093752 A1 * 5/2005 Cheng et al. ..... 343/702
2005/0168392 A1 * 8/2005 Hagiwara ..... 343/773
2006/0164308 A1 * 7/2006 Cohen ..... 343/700 MS
2007/0063902 A1 * 3/2007 Leisten ..... 343/702

* cited by examiner

*Primary Examiner*—Huedung Mancuso
(74) *Attorney, Agent, or Firm*—Troxell Law Office, PLLC

(57) ABSTRACT

A printed antenna suitable for wireless networking device comprising a base plate, a grounding member, a first antenna, a second antenna and a third antenna is disclosed. The base plate is made of dielectric material where on a surface of which a first direction and a second direction perpendicular to each other are defined. The grounding member is electrically grounded and covers at least a partial area of the base plate surface. The first antenna is a dipole antenna extending from the grounding member generally towards the first direction. The second antenna is a monopole antenna extending from the grounding member generally towards the second direction. The third antenna is a monopole antenna extending from the grounding member generally towards the second direction. The second antenna and the third antenna are substantially disposed on the two opposing sides of first antenna.

15 Claims, 9 Drawing Sheets

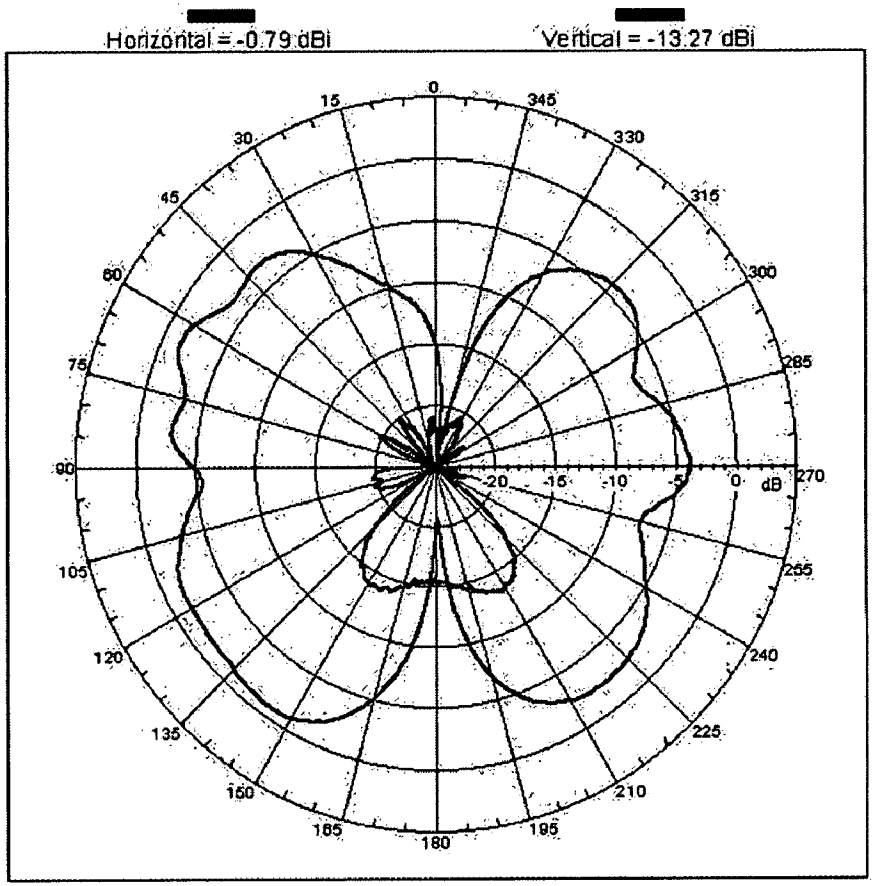
FIG.3 (PRIOR ART)
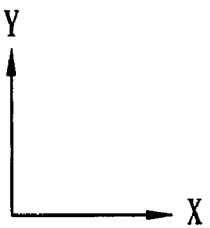

PRINTED ANTENNA AND A WIRELESS NETWORK DEVICE HAVING THE ANTENNA

BACKGROUND OF INVENTION

1. Field of the Invention

The present invention relates to a kind of printed antenna, more particularly a printed antenna suitable for MIMO wireless networking device and a wireless networking device having the same.

2. Description of the Prior Art

FIG. 1 depicts the perspective view of a typical wireless networking device 10, comprising a body 11, internal circuitry 12 disposed inside the body, a connecting member 13 disposed at one end of body 11 to connect an external host (not shown in the figure), and an antenna signal transceiver 14 arranged on the other end of body 11 and corresponding to the connecting member 13. Generally, the shell of antenna signal transceiver 14 is made of non-metallic material. When the wireless networking device 10 is connected to an external host, the antenna signal transceiver 14 must be exposed outside the external host for effective receiving and transmission of wireless signals. Based on the practice of regular users, the X-Y plane as shown in FIG. 1 should be the plane with better wireless signal transmission. Thus the design of antenna for wireless networking device 10 focuses primarily on how to improve the isolation between antennas mounted in X-Y direction and reduce the dead space in the radiation pattern of antenna so as to enhance the receiving and transmitting ability of antenna on X-Y plane.

FIG. 2 depicts the diagram of a conventional internal circuitry 20 in a MIMO wireless networking device. The conventional internal circuitry 20 comprises a base plate 21, a control circuit disposed on the base plate 21, a grounding member 23 covering a predefined area of base plate 21, and an antenna unit 24 electrically connected to the control circuit 22.

Antenna design that complies with the MIMO spec wireless networking device uses three antennas to form a three transmitter/two receiver antenna unit. For example, in the conventional MIMO antenna unit 24 as shown in FIG. 2, it includes a first antenna 241 configured in the middle, and a second antenna 242 and a third antenna 243 disposed respectively on each side of first antenna 241. The three antennas 241, 242, 243 are monopole antennas adjacent to each other and facing the same direction (i.e. in X direction on the right side of FIG. 2). The three antennas 241, 242, 243 respectively pass (cross) through grounding member 23 to connect to control circuit 22 via a first, a second and a third feedline 251, 252, 253 and are driven and controlled by the control circuit 22. A major drawback in this kind of conventional MIMO antenna unit 24 is that its three monopole antennas 241, 242, 243 are arranged next to each other and extend in the same direction, resulting in inadequate isolation between adjacent antennas (e.g. between first antenna 241 and second antenna 242). In addition, the design of using monopole for first antenna 241 results in bigger dead space in the radiation pattern on the X-Y plane. FIG. 3 shows the radiation pattern measured from the X-Y plane of first antenna 241 used by the conventional MIMO antenna unit 24 as depicted in FIG. 2. As shown, the maximum horizontal gain of conventional first antenna 241 is merely −0.79 dBi, meaning there is practically no gain. FIG. 4 illustrates the isolation graph measured between first antenna 241 and second antenna 242 in the conventional MIMO antenna unit 24 as shown in FIG. 2. Based on the graph, the isolation between conventional first antenna 241 and second antenna 242 in the operating frequency range of 2.4 GHz and 2.5 GHz is approximately −6.01 dB, which is still higher than the −10 dB or under requirement in the market for high-performance antenna and leaves room for further improvement.

SUMMARY OF INVENTION

The first object of the present invention is to provide a printed antenna with better radiation pattern to improve gain and reduce dead space and having better antenna-to-antenna isolation to avoid interference and enhance antenna performance.

The second object of the present invention is to provide a printed antenna which uses a dipole antenna coupled with a monopole antenna on each side to form a three transmission/two receiver antenna configuration for use in MIMO wireless networking device.

The third object of the present invention is to provide a printed antenna for MIMO wireless networking device which includes three antennas with two adjacent antennas extending in approximately vertical arrangement to improve the antenna-to-antenna isolation.

The fourth object of the present invention is to provide a wireless networking device having a printed antenna of the invention.

To achieve the aforesaid objects, the printed antenna of the present invention changes its middle antenna in the three-antenna configuration of the MIMO antenna unit to a T-dipole antenna and arranges the two monopole antennas on each side of the T-dipole in a direction generally vertical to the T-dipole. Such arrangement is different from the conventional three-antenna system where all three antennas are adjacent to each other and face the same direction. As such, in the printed antenna of the invention, the T-dipole antenna which itself is a radiator and the grounding member configured between the T-dipole and the monopole antenna helps enhance the isolation between two adjacent antennas. In addition, the design of a T-dipole antenna coupled with a monopole antenna on each side extending in different direction can produce better radiation pattern on X-Y plane and higher gain, hence greatly improving the antenna performance.

BRIEF DESCRIPTION OF THE DRAWINGS

The details of the present invention will be more readily understood from a detailed description of the preferred embodiments taken in conjunction with the following figures.

FIG. 3 is the radiation pattern measured from X-Y plane of the first antenna 241 in the conventional MIMO antenna unit shown in FIG. 2.

DETAILED DESCRIPTION

Figure 5:
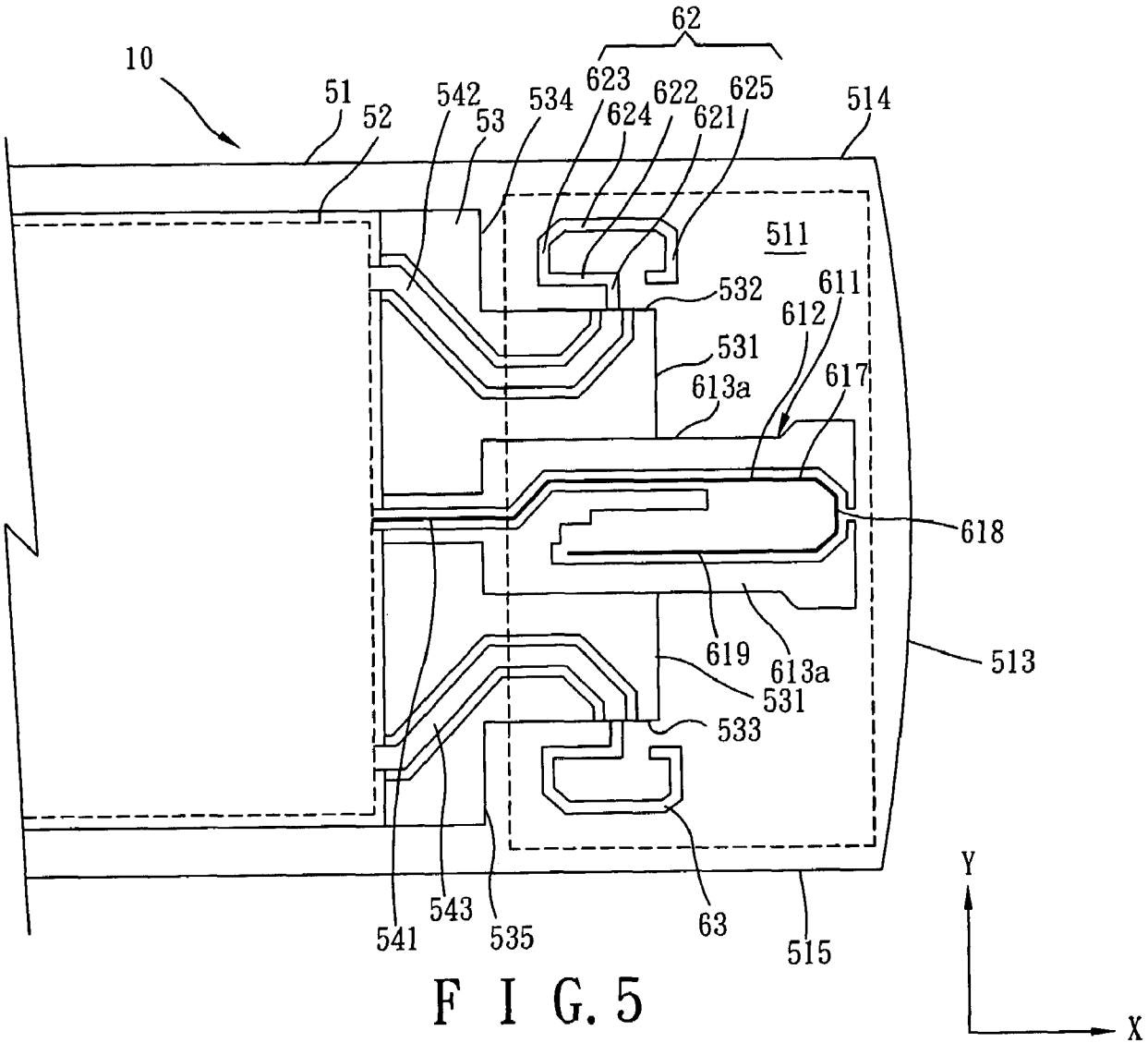
FIG. 5 shows the component side in one preferred embodiment of the internal circuitry of the wireless networking device having a printed antenna according to the invention.
Figure 6:
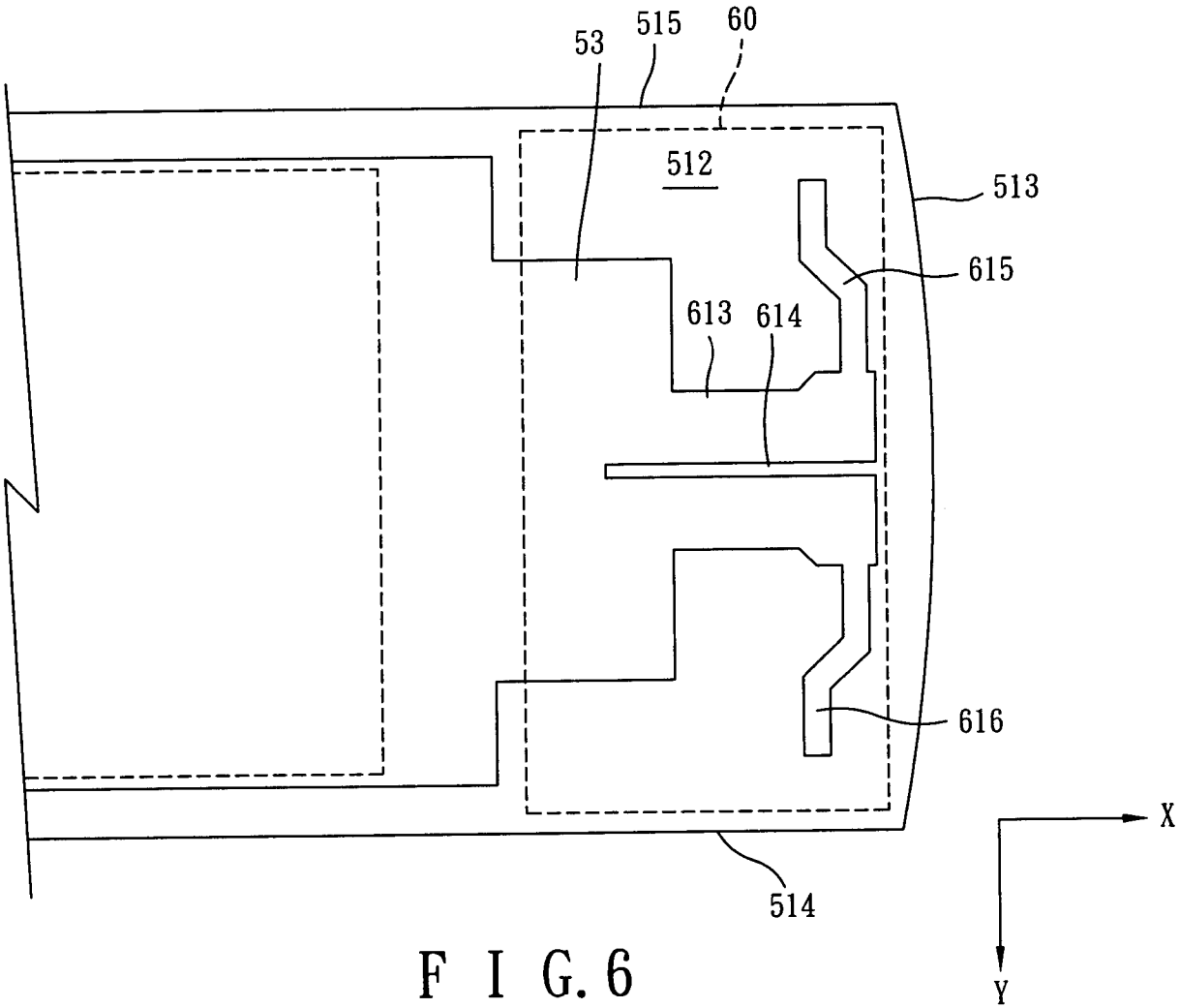
FIG. 6 shows the solder side in one preferred embodiment of the internal circuitry of the wireless networking device having a printed antenna according to the invention.
Figure 7:
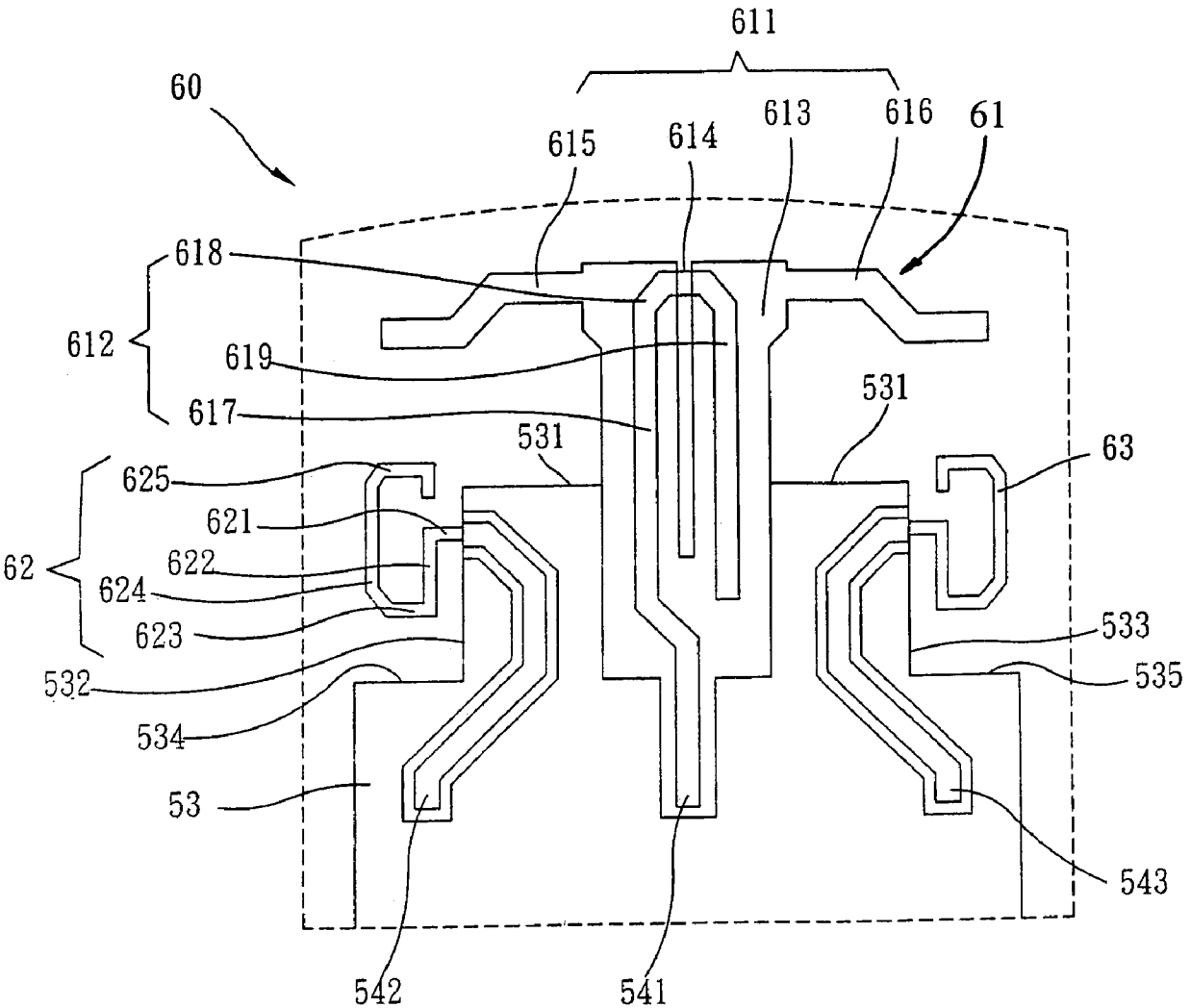
FIG. 7 is a magnified view of the printed antenna of the invention in the wireless networking device as shown in FIG. 5 and FIG. 6.

FIGS. 5~7 disclose a preferred embodiment of the printed antenna 60 and a wireless networking device 50 having printed antenna 60 according to the invention. FIG. 5 and FIG. 6 show respectively the component side and the solder side of the internal circuitry of the wireless networking device 50 having a printed antenna 60 according to the invention. FIG. 7 is a magnified view of the printed antenna 60 in the wireless networking device shown in FIG. 5 and FIG. 6.

As shown in FIG. 5, the wireless networking device 50 having a printed antenna 60 according to a preferred embodiment of the invention comprises: a base plate 51, a control circuit 52, a grounding member 53 and a printed antenna 60.

The base plate 51 is made of dielectric material in the shape of a generally flat rectangle. In a preferred embodiment, the base plate 51 is a FR4 circuit board. The base plate 51 has a component side surface disposed with a plurality of electronic circuits (called first surface 511 or top surface below) and a solder side surface disposed with a plurality of solder points (called second surface 512 or bottom surface below as shown in FIG. 6). The first surface 511 of base plate 51 is defined with a first direction (X direction) and a second direction (Y direction) perpendicular to each other, and the base plate 51 has a first edge 513 generally perpendicular to the first direction, and a second edge 514 and a third edge 515 generally perpendicular to the second direction. The second edge 514 and the third edge 515 are respectively connected to each end of first edge 513.

The control circuit 52 is generally provided on the first surface 511 of base plate 51 and comprises a plurality of IC components and a plurality of electronic components to provide the function of wireless network transmission. The control circuit 52 can be implemented using prior art.

The grounding member 53 is electrically grounded (GND) and covers at least partial area on the first surface 511 and the second surface 512 of base plate 51, in particular the area on first surface 511 adjacent to the printed antenna 60 and extensively a major part of second surface 512 other than the part opposing the printed antenna 60. The grounding member 513 also provides the function of resonance with printed antenna 60 in addition to grounding. In a preferred embodiment, the grounding member 53 is a first space (not numbered) apart from the first edge 513 in the first direction (X direction), a second space (not numbered) apart from the second edge 514 in the second direction (Y direction), and a third space (not numbered) apart from the third edge 515 in the second direction (Y direction). In the area adjoining printed antenna 60, the areas on first surface 511 and second surface 512 covered by the grounding member 53 generally correspond to each other and have the same contour.

The printed antenna 60 is arranged on base plate 51 at a place uncovered by grounding member 53. The printed antenna 60 connects to control circuit 52 by means of a plurality of feedlines 541, 542, 543 so as to provide the function of wireless signal receiving/transmission. In a preferred embodiment, the printed antenna further comprises: a first antenna 61, a second antenna 62, and a third antenna 63. The first antenna 61 extends from a front edge 531 of grounding member 53 generally towards the first edge 513 and is positioned exactly in the first space. The second antenna 62 extends from a first side edge 532 of grounding member 53 generally towards the second edge 514 and is positioned exactly in the second space. The third antenna 63 extends from a second side edge 533 of grounding member 53 generally towards the third edge 515 and is positioned exactly in the third space. The grounding member 53 on the first surface 511 also comes with a first rear edge 534 extending from the end of first side edge 532 to the second edge 514, and a second rear edge 535 extending from the end of second side edge 533 to the third side edge 515. As shown in FIG. 5, the edges 531~535 of grounding member 53 constitute substantially a ladder-shaped structure. On each side of the front edge 531 of grounding member 53, there forms an ungrounded square area defined respectively by the first side edge 532 and the first rear edge 534, and the second side edge 533 and the second rear edge 535. The second antenna 62 and the third antenna 63 are exactly and respectively positioned in the ungrounded area defined by the first side edge 532 and the first rear edge 534, and in the ungrounded area defined the second side edge 533 and the second rear edge 535. As such, the second antenna 62 and the third antenna 63 are substantially isolated from each other by the grounding member 53, and the grounding member 52 also provides isolation between the first antenna 61 and the second antenna 62 (or the third antenna 3) to some extent.

As shown in FIGS. 5 & 6, first antenna 61 is a T-dipole antenna which further comprises: a T-shaped radiating element 611 and a microstrip line 612. The T-shaped radiating element 611 is configured on the second surface 512 of base plate 51 and comprises: a body 613, a long narrow slot 614, and two extension members 615, 616. The body 613 extends from grounding member 53 along the first direction to a place adjacent to first edge 513. The long narrow slot 614 is formed in the middle of body 613 and extends a predetermined length from the end of first edge 513 nearer the body 613 along the first direction towards the grounding member 53. The two extension members 615, 616 respectively extend a predetermined length from the left and right side of body 613 at the end nearer first edge 513 in a direction generally parallel to the second direction. The body 613 of T-shaped radiating element 611 is connected to the grounding member 53 on second surface 512. In an area on the first surface 511 adjoining the vicinity of microstrip line 612, another body 613*a* opposing and having the same contour as body 613 on second surface 512 is disposed. This another body 613*a* is connected to the grounding member 53 situated on first surface 511.

The microstrip line 612 is positioned on the first surface 511 of base plate 51 and adjoins the long narrow slot 614. The microstrip line 612 comprises: a first long narrow member 617, a bend member 618, and a second long narrow member 619. The first long narrow member 617 extends from the grounding member 53 in a direction roughly parallel to the direction of long narrow slot 614 to a place near the first edge 513. One end of the bend member 618 is connected to one end of the first long narrow member 617 and extends along the second direction to cross over the long narrow slot 614. One end of the second long narrow member 619 is connected to the other end of bend member 618 and extends in a direction roughly parallel to the long narrow slot 614 towards the grounding member 53. The body 613 and the extension members 615, 616 at its end that extend towards the sides visually constitute a T-shape. The microstrip line 612 and T-shaped radiating element 611 combined together possess the properties of a dipole antenna, thus called T-dipole antenna.

Again referring to FIG. 5, in this preferred embodiment, the second antenna 62 and the third antenna 63 are disposed on two opposing sides of first antenna 61 in a substantially symmetrical manner, and the shapes of the second antenna 62 and the third antenna 63 substantially correspond to each other. Thus only the structure of the second antenna 62 is described below without reiterating the configuration of the third antenna 63.

In a preferred embodiment, the second antenna 62 comprises: an end-section member 621, a first bend section 622, a second bend section 623, a third bend section 624, and a fourth bend section 624. One end of the end-section member 621 adjoins the first side edge 532 of grounding member 53 and protrudes a small length towards the second direction. One end of the first bend section 622 is connected to the other end of said end-section member 621 and extends a first length roughly along the first direction away from the first edge 513. One end of the second bend section 623 is connected to the other end of first bend section 622 and extends a second length roughly along the second direction towards the second edge 514. One end of the third bend section 624 is connected to the other end of second bend section 623 and extends a third length roughly along the first direction towards the first edge 513. One end of the fourth bend section 625 is connected to the other end of third bend section 624 and extends a fourth length roughly along the second direction away from the second edge 514. As shown in FIG. 5, the first to fourth bend sections 622~625 of second antenna 62 roughly constitute a D-shaped antenna structure. The space between the first and the second bend sections 622, 623 of the second antenna 62 and the first side edge 532 and the first rear edge 534 of the grounding member 53 substantially forms a resonance surface of second antenna 62. The D-shaped area configured between the third and the fourth bend sections 624, 625 and the first and the second bend sections 622, 623 substantially forms a resonance chamber of second antenna 62 to provide good antenna performance.

As shown in FIG. 7, the printed antenna 60 can change its operating frequency bandwidth or range by adjusting the length or bend at different parts of antennas 61, 62, 63. For example, changing the extension length of the long narrow slot 614 of first antenna 61 can decide the width of the operating frequency range of first antenna 61. Also, adjusting the length of first long narrow member 617 and second long narrow member 619 of the microstrip line 612 of first antenna 61 can change the operating frequency range of first antenna 61. Also, adjusting the length of the first bend-section 622 and second bend-section 623 of second antenna 62 (or third antenna 63) can decide the width of operating frequency range of second antenna 62 (or third antenna 63). Changing the length and location of the third bend-section 624 can adjust its operating frequency range.

In the example of wireless networking device 50 for WLAN that complies with IEEE802.11g, the operating frequency range of its printed antenna 60 must be in the range of 2.4 GHz~2.5 GHz. In a preferred embodiment, the lengths and relative positions of antennas 61, 62, 63 of the printed antenna 60 can be designed in the following manner:

1. The length of the two extension members 615, 616 of the T-shaped radiating element 611 of first antenna 61 (measured from the end of long narrow slot 614) is respectively ¼ wavelength of the operating frequency range of first antenna 61, and the shapes of the two extension members 615, 616 are symmetrical to each other.

2. The total length of the long narrow slot 614 of the T-shaped radiating element 611 of first antenna 61 is approximately ¼ wavelength of the operating frequency range of first antenna 61.

3. The first and the second long narrow members 617, 619 of the microstrip line 612 of first antenna 61 are respectively 50 ohm microstrips and their length is respectively ¼ wavelength of the operating frequency range of first antenna 61, while the bend member 618 is relatively shorter. Thus substantially the total length of microstrip line 612 is equal to ½ wavelength of the operating frequency range of first antenna 61.

4. The point at where feedline 542, 543 is connected to second antenna 62 and third antenna 63 respectively is called the feedpoint of the second antenna 62 and the third antenna 63. The feedpoint of first antenna 61 is located at where its bend member 618 crosses over the long narrow slot 614. As such, the distance between the feedpoint of first antenna 61 and that of second antenna 62 is approximately ¼ wavelength of the operating frequency range of first antenna 61.

5. In the second antenna 62, the combined length of first bend section 622 and second bend section 623 is approximately ⅛ wavelength of the operating frequency range of second antenna 62, and the combined length of the third bend section 624 and fourth bend section 625 is also approximately ⅛ wavelength of the operating frequency range of second antenna 62.

In a preferred embodiment, the plurality of feedlines 541, 542, 543 are 50 ohm microstrips to provide better power shift function.

As shown in FIGS. 5~7, the unique design of printed antenna 60 of the invention enable the second antenna 62 and the third antenna 63 to be isolated from each other by grounding member 53. In addition, the radiating element 611 of the first antenna 61 (T-dipole antenna) and the grounding member 53 situated between the first antenna 61 and second antenna 62 will enhance the isolation between two antennas 61, 62. Also, the design of T-dipole antenna (first antenna 61) coupled with two monopole antennas (second antenna 62 and third antenna 63) on each side extending in different directions also produces better radiation pattern and higher gain on X-Y plane, thereby greatly enhancing the antenna performance.

Figure 8:
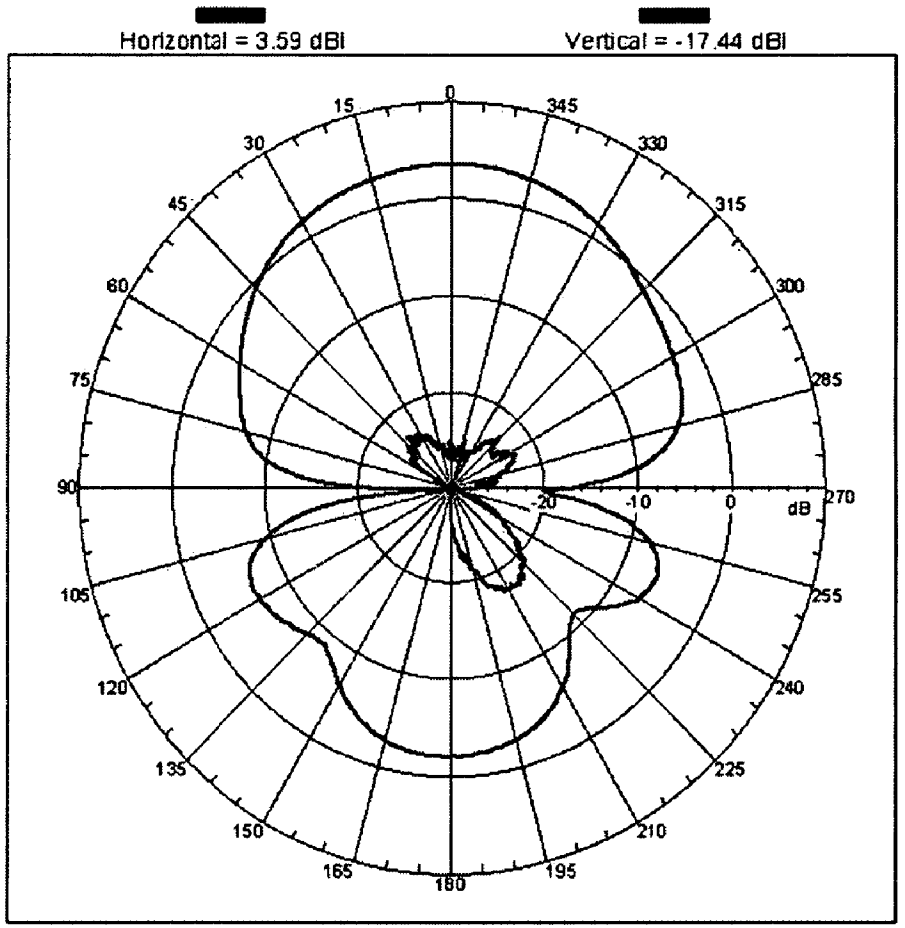
FIG. 8 is the radiation pattern measured from the X-Y plane of the first antenna in the printed antenna of the invention as shown in FIG. 5 and FIG. 6.
Figure 9:
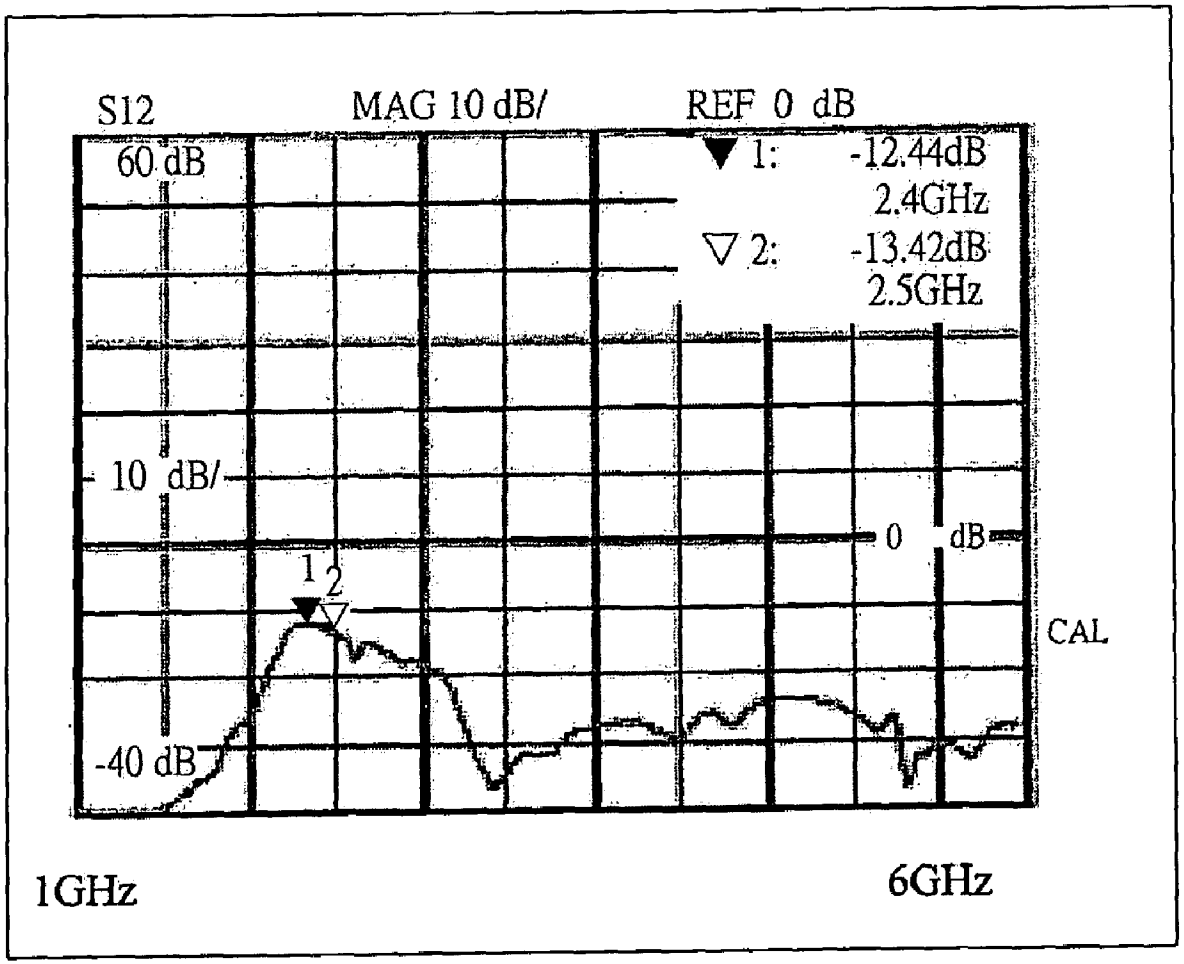
FIG. 9 is an isolation graph measured between the first antenna and the second antenna in the printed antenna as shown in FIG. 5 and FIG. 6.

Referring to FIG. 8 and FIG. 9, FIG. 8 shows the radiation pattern measured from the X-Y plane of the first antenna 61 in the printed antenna 60 of the invention as shown in FIG. 5 and FIG. 6. FIG. 9 shows the isolation graph measured between the first antenna 61 and the second antenna 62 of the printed antenna 60 as shown in FIG. 5 and FIG. 6.

Figure 1:
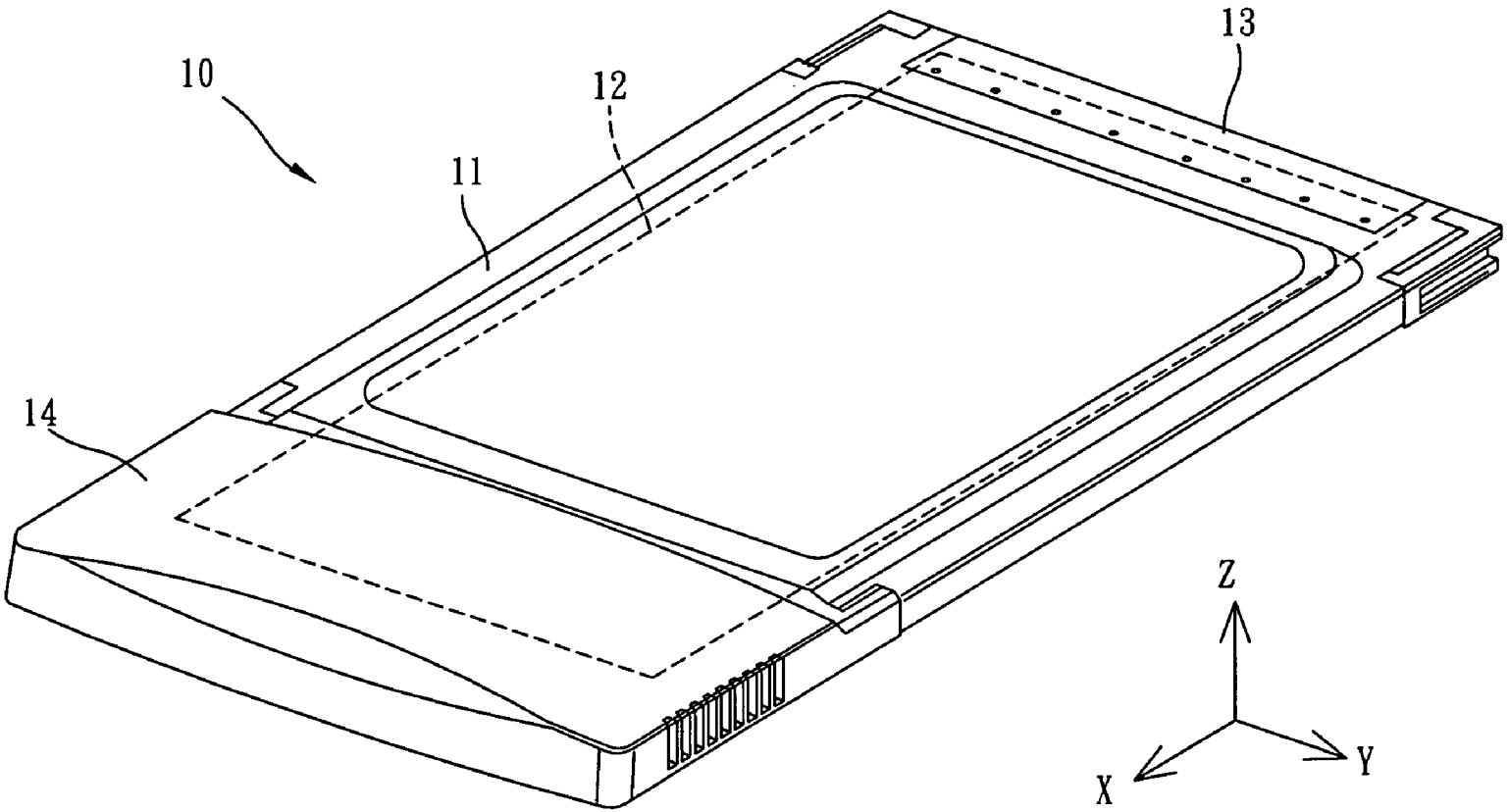
FIG. 1 (PRIOR ART)
FIG. 1 is a perspective view of a typical wireless networking device.
Figure 2:
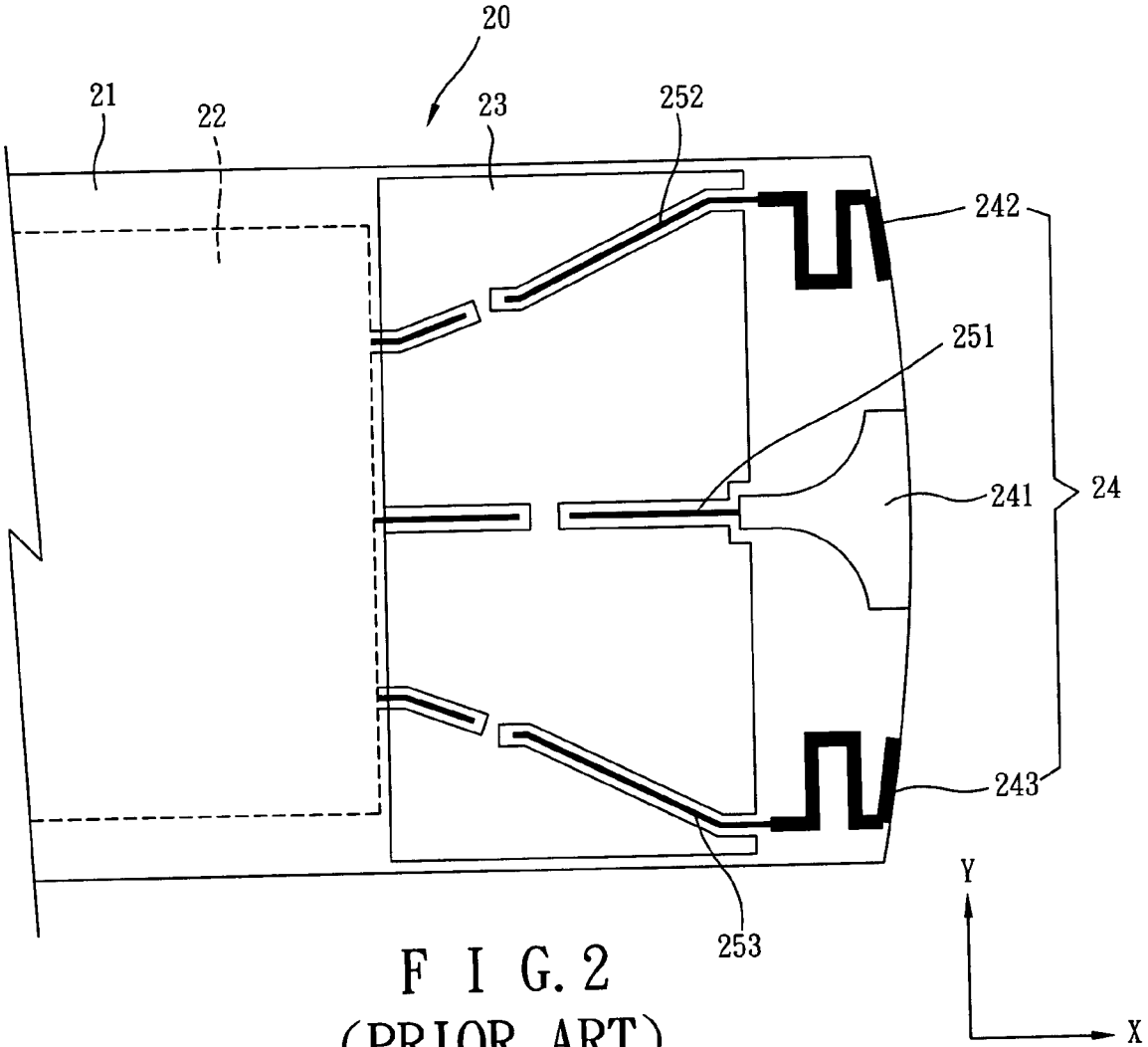
FIG. 2 (PRIOR ART)
FIG. 2 is a diagram showing the conventional internal circuitry of a MIMO wireless networking device.
Figure 4:
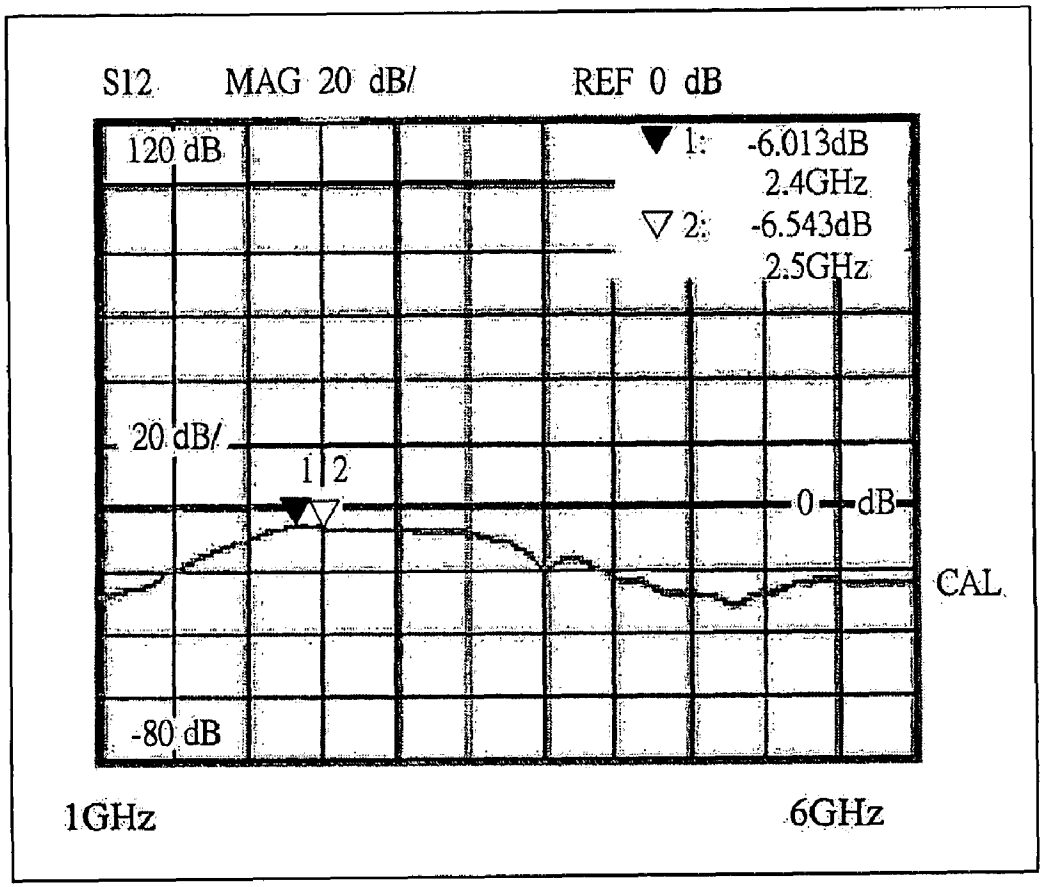
FIG. 4 (PRIOR ART)
FIG. 4 is an isolation graph measured between the first antenna and the second antenna of the conventional MIMO antenna unit shown in FIG. 2.

It is seen from the radiation pattern in FIG. 8 that the horizontal gain of first antenna 61 of printed antenna 60 reaches 3.59 dBi, which is much higher than the gain of −0.79 dBi from prior art as shown in FIG. 2. It is conceivable that printed antenna 60 of the invention provides better wireless signal communication quality and transmission efficiency than prior art. Also as seen from the isolation graph in FIG. 9, in the operating frequency range of 2.4 GHz~2.5 GHz, the isolation between the first antenna 61 and second antenna 62 of the printed antenna 60 can be as low as −13.42 dB. Such isolation value is not only far superior to the −6.01 dB produced by prior art as shown in FIG. 2, it also surpasses the market requirement of −10 dB or under isolation for high-performance antenna. The present invention apparently greatly improves the antenna design and performance of prior art.

While the preferred embodiments of the present invention have been set forth for the purpose of disclosure, modifications of the disclosed embodiments of the present invention as well as other embodiments thereof may occur to those skilled in the art. Accordingly, the appended claims are intended to cover all embodiments which do not depart from the spirit and scope of the present invention.

What is claimed is:

1. A printed antenna for wireless networking device, comprising:

a base plate, on a surface of which a first direction and second direction perpendicular to each other are defined; the base plate having at least a first edge generally perpendicular to the first direction, and a second edge generally perpendicular to the second direction;

a grounding member electrically grounded and covering at least a partial area of the base plate surface; the grounding member being a first space apart from the first edge in the first direction, and being a second space apart from the second edge in the second direction;

a first antenna, extending from grounding member generally towards the first edge and positioned in the first space; and a second antenna, extending from grounding member generally towards the second edge and positioned in the second space, wherein said first antenna is a dipole antenna, and said second antenna is a monopole antenna, wherein said base plate has a first surface and a second surface opposing each other and having grounding member covered thereon; the areas on the two surfaces covered by the grounding member generally correspond to each other and have the same contour; the first antenna and the second antenna are provided on the first surface, wherein said first antenna is a T-dipole antenna and further comprises:

a T-shaped radiating element configured on the second surface of base plate and comprising:

a body extending from grounding member along the first direction to a place adjacent to first edge, a long narrow slot formed in the middle of body and extending a predetermined length from the end of first edge nearer the body along the first direction towards the grounding member; and two extension members respectively extending a predetermined length from the left and right side of body at the end nearer the first edge in a direction generally parallel to the second direction; and a microstrip line positioned on the first surface of base plate and adjoining the long narrow slot; said microstrip line comprising: a first long narrow member extending from the grounding member in a direction roughly parallel to the direction of long narrow slot to a place near the first edge, a bend member with one end connected to an end of the first long narrow member and extending along the second direction to cross over the long narrow slot, and a second long narrow member with one end connected to the other end of bend member and extending in a direction roughly parallel to the long narrow slot towards the grounding member.

2. The printed antenna according to claim 1, further comprising a third antenna positioned on the other side of grounding member opposing the second antenna so as to be isolated from the second antenna by the grounding member, and having a shape substantially corresponding to the shape of the second antenna.

3. The printed antenna according to claim 1, wherein the length of the two extension members of said T-shaped radiating element is respectively and approximately one-quarter wavelength of the operating frequency range of first antenna and the shapes of two extension members are symmetrical to each other.

4. The printed antenna according to claim 1, wherein the length of long narrow slot of said T-shaped radiating element is approximately one-quarter wavelength of the operating frequency range of first antenna.

5. The printed antenna according to claim 1, wherein the first and the second long narrow member of said microstrip line are respectively a 50 ohm microstrip and their length is respectively one quarter wavelength of the operating frequency range of said first antenna, while the length of bend member is relatively shorter, so that substantially the total length of said microstrip line is approximately equal to one-half wavelength of the operating frequency range of first antenna.

6. The printed antenna according to claim 1, wherein the second antenna comprises: an end-section member with one end adjoining the grounding member and protruding a small length towards the second direction, a first bend section with one end connected to the other end of end-section member and extending a first length roughly along the first direction away from the first edge, a second bend section with one end connected to the other end of first bend section and extending a second length roughly along the second direction towards the second edge, a third bend section with one end connected to the other end of second bend section and extending a third length roughly along the first direction towards the first edge; and a fourth bend section with one end connected to the other end of third bend section and extending a fourth length roughly along the second direction away from the second edge.

7. The printed antenna according to claim 6, wherein the first and the second bend sections of said second antenna substantially form a resonance surface of the second antenna with the grounding member, and the third and the fourth bend sections substantially form a resonance chamber of the second antenna with the first and the second bend sections.

8. The printed antenna according to claim 6, wherein the combined length of said first and second bend sections is approximately one-eighth wavelength of the operating frequency range of the second antenna, and the combined length of said third and fourth bend sections is approximately one-eighth wavelength of the operating frequency range of the second antenna.

9. A printed antenna for wireless networking device, comprising:

a base plate made of dielectric material, on a surface of which a first direction and a second direction perpendicular to each other are defined;

a grounding member electrically grounded and covering at least a partial area on said base plate surface;

a first antenna which is a dipole antenna extending from the grounding member generally towards the first direction;

a second antenna which is a monopole antenna extending from the grounding member generally towards the second direction; and a third antenna which is a monopole antenna extending from the grounding member generally towards a direction opposite to the second direction;

wherein the second antenna and the third antenna are substantially disposed on the two opposing sides of first antenna, wherein said base plate has at least a first edge generally perpendicular to the first direction, and a second edge and a third edge generally perpendicular to the second direction; the second edge and the third edge are respectively connected to each end of first edge;

said grounding member is a first space apart from the first edge in the first direction, a second space apart from the second edge in the second direction, and a third space apart from the third edge in the second direction; and said first antenna is positioned in the first space, the second antenna is situated in the second space, the third antenna is situated in the third space, such that the second antenna and the third antenna are isolated from each other by the grounding member, and the shape of third antenna substantially corresponds to the shape of second antenna.

10. The printed antenna according to claim 9, wherein said base plate has a first surface and a second surface opposing each other and having grounding member covered thereon; the areas on the two surfaces covered by the grounding member generally correspond to each other and have the same contour; the first antenna and the second antenna are provided on the first surface; and said first antenna is a T-dipole antenna and further comprises:

a T-shaped radiating element configured on the second surface of base plate and comprising:

a body extending from grounding member along the first direction to a place adjacent to first edge, a long narrow slot formed in the middle of body and extending a predetermined length from the end of first edge nearer the body along the first direction towards the grounding member; and two extension members respectively extending a predetermined length from the left and right side of body at the end nearer the first edge in a direction generally parallel to the second direction; and a microstrip line positioned on the first surface of base plate and adjoining the long narrow slot; said microstrip line comprising: a first long narrow member extending from the grounding member in a direction roughly parallel to the direction of long narrow slot to a place near the first edge, a bend member with one end connected to an end of the first long narrow member and extending along the second direction to cross over the long narrow slot, and a second long narrow member with one end connected to the other end of bend member and extending in a direction roughly parallel to the long narrow slot towards the grounding member.

11. The printed antenna according to claim 9, wherein said second antenna comprises:

an end-section member with one end adjoining the grounding member and protruding a small length towards the second direction, a first bend section with one end connected to the other end of end-section member and extending a first length roughly along the first direction away from the first edge, a second bend section with one end connected to the other end of first bend section and extending a second length roughly along the second direction towards the second edge, a third bend section with one end connected to the other end of second bend section and extending a third length roughly along the first direction towards the first edge; and a fourth bend section with one end connected to the other end of third bend section and extending a fourth length roughly along the second direction away from the second edge.

12. A wireless networking device, comprising:

a base plate made of dielectric material;

a control circuit disposed on the base plate to provide the function of wireless network transmission;

a grounding member electrically grounded and covering at least a partial area of the base plate surface; and a printed antenna provided on the base plate at where not covered by the grounding member and connected to the control circuit via a plurality of feedlines to provide the function of wireless signal receiving/transmission;

wherein said printed antenna further comprises: a first antenna which is a dipole antenna, a second antenna which is a monopole antenna, and a third antenna which is a monopole antenna; the second antenna and the third antenna are substantially situated on two opposing sides of the first antenna and their shapes substantially correspond to each other, wherein a first direction and a second direction perpendicular to each other are defined on a surface of said base plate, and the base plate has at least a first edge generally perpendicular to the first direction, and a second edge and a third edge generally perpendicular to the second direction; the second edge and the third edge are respectively connected to each end of first edge;

said grounding member is a first space apart from the first edge in the first direction, a second space apart from the second edge in the second direction, and a third space apart from the third edge in the second direction; and said first antenna is positioned in the first space, the second antenna is situated in the second space, the third antenna is situated in the third space, such that the second antenna and the third antenna are isolated from each other by the grounding member.

13. The wireless networking device according to claim 12, wherein said base plate has a first surface and a second surface opposing each other and having grounding member covered thereon; the areas on the two surfaces covered by the grounding member generally correspond to each other and have the same contour; the first antenna and the second antenna are provided on the first surface; and said first antenna is a T-dipole antenna and further comprises:

a T-shaped radiating element configured on the second surface of base plate and comprising:

a body extending from grounding member along the first direction to a place adjacent to first edge, a long narrow slot formed in the middle of body and extending a predetermined length from the end of first edge nearer the body along the first direction towards the grounding member; and two extension members respectively extending a predetermined length from the left and right side of body at the end nearer the first edge in a direction generally parallel to the second direction; and a microstrip line positioned on the first surface of base plate and adjoining the long narrow slot; said microstrip line comprising: a first long narrow member extending from the grounding member in a direction roughly parallel to the direction of long narrow slot to a place near the first edge, a bend member with one end connected to an end of the first long narrow member and extending along the second direction to cross over the long narrow slot, and a second long narrow member with one end connected to the other end of bend member and extending in a direction roughly parallel to the long narrow slot towards the grounding member.

14. The wireless networking device according to claim 13, wherein the point at where said plurality of feedlines are connected to second antenna and third antenna are respectively called the feedpoint of the second antenna and the third antenna; the feedpoint of first antenna is located at where its bend member crosses over the long narrow slot, and the distance between the feedpoint of first antenna and that of second antenna is approximately one-quarter wavelength of the operating frequency range of first antenna.

15. The wireless networking device according to claim 12, wherein said second antenna comprises:

an end-section member with one end adjoining the grounding member and protruding a small length towards the second direction, a first bend section with one end connected to the other end of end-section member and extending a first length roughly along the first direction away from the first edge, a second bend section with one end connected to the other end of first bend section and extending a second length roughly along the second direction towards the second edge, a third bend section with one end connected to the other end of second bend section and extending a third length roughly along the first direction towards the first edge; and a fourth bend section with one end connected to the other end of third bend section and extending a fourth length roughly along the second direction away from the second edge.

* * * * *